US006520702B2

(12) United States Patent
Heusser

(10) Patent No.: US 6,520,702 B2
(45) Date of Patent: Feb. 18, 2003

(54) ADAPTER FOR A STATIC MIXER

(75) Inventor: Rolf Heusser, Winterthur (CH)

(73) Assignee: Sulzer Chemtech AG, Winterthur (CH)

( * ) Notice: Subject to any disclaimer, the term of this patent is extended or adjusted under 35 U.S.C. 154(b) by 0 days.

(21) Appl. No.: 09/992,846

(22) Filed: Nov. 14, 2001

(65) Prior Publication Data

US 2002/0076260 A1 Jun. 20, 2002

(30) Foreign Application Priority Data

Nov. 29, 2000 (EP) ..... 00811134

(51) Int. Cl.[7] ..... B05C 11/00

(52) U.S. Cl. ..... 401/266; 401/265; 401/261; 222/566

(58) Field of Search ..... 401/266, 265, 401/261, 262, 263, 264, 44, 47, 194; 222/566–567, 568, 569, 570, 571, 572, 573, 574, 145.1–145.4; 116/307

(56) References Cited

U.S. PATENT DOCUMENTS 378,743 A * 2/1888 Underwood ..... 401/266
2,549,233 A * 4/1951 Phillips ..... 222/145.1
4,872,778 A * 10/1989 Longo ..... 401/206
4,878,599 A * 11/1989 Greenway ..... 222/1
4,899,909 A 2/1990 Summons et al.
5,000,361 A 3/1991 Bridell et al.

* cited by examiner

*Primary Examiner*—David J. Walczak
(74) *Attorney, Agent, or Firm*—Townsend and Townsend and Crew LLP

(57) ABSTRACT

The adapter (3) is provided for a static mixer (1) to carry out a shaped dispensing of a viscid mixture from the mixer. The adapter is formed in the shape of a plastic injection-molded part such that it is mountable on a discharge orifice (11) of the mixer. It forms a passage with a variable cross-section with a wall (33), with the flow of the mixture being guidable though said passage to a slit-shaped outlet opening (4). The passage wall (33) is provided with linear cutting aids (40) on the outside which extend at least approximately parallel to the slit direction of the outlet opening (4). The passage wall can be cut through along these cutting aids so that a new, slit-shaped outlet opening **(4*a*)** is created which is shorter than the original outlet opening in the slit direction. The linear cutting aids are arranged such that the newly made outlet openings have pre-set cross-sectional areas.

14 Claims, 3 Drawing Sheets

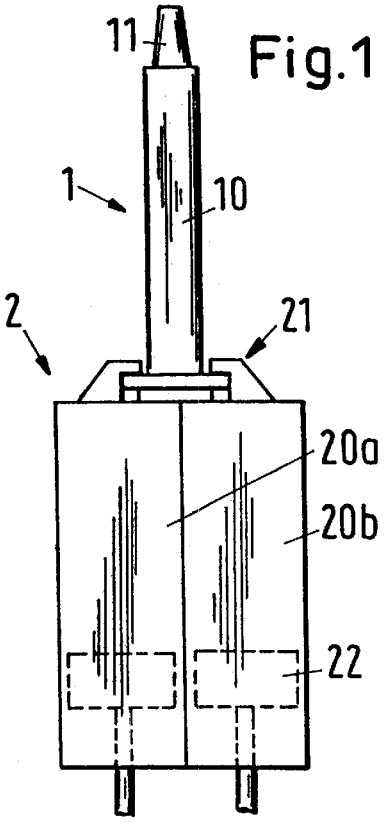
Fig.1
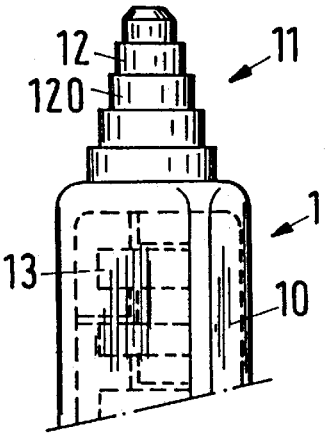
Fig.2
Fig.3
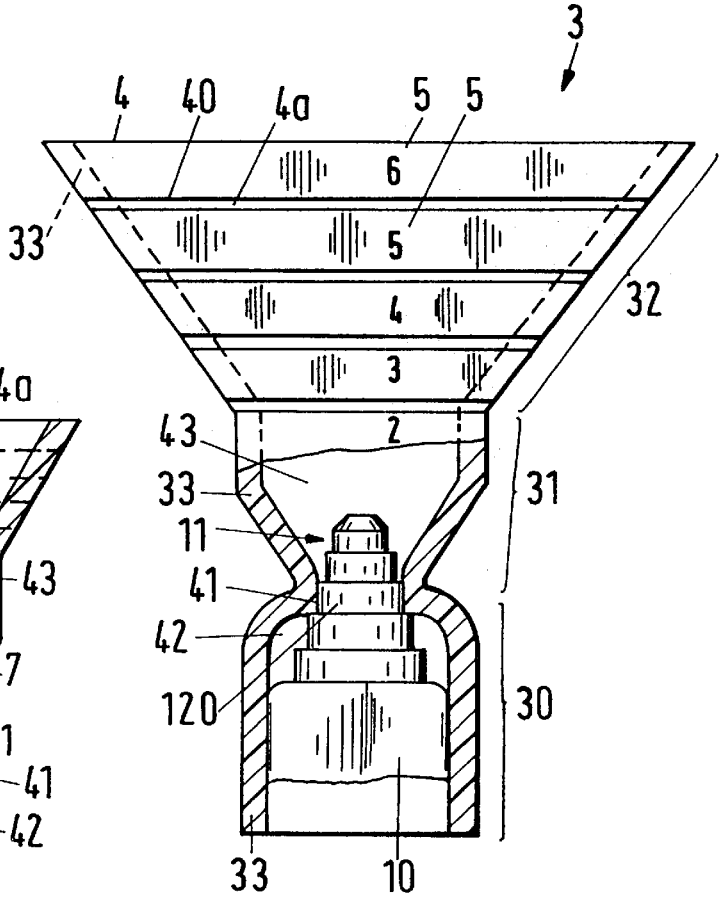
Fig.4
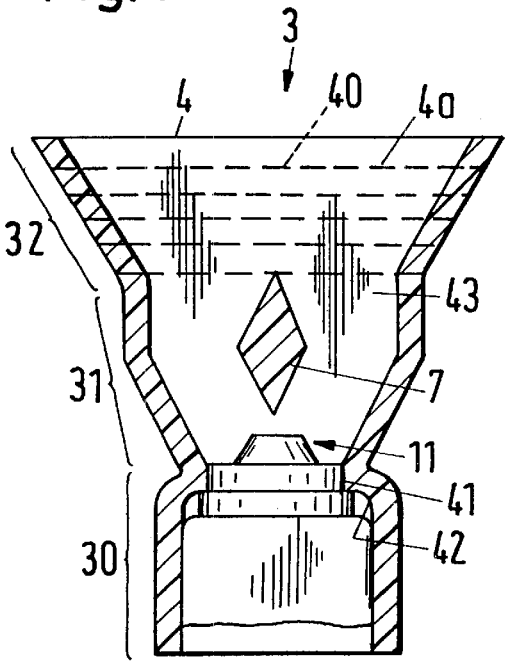

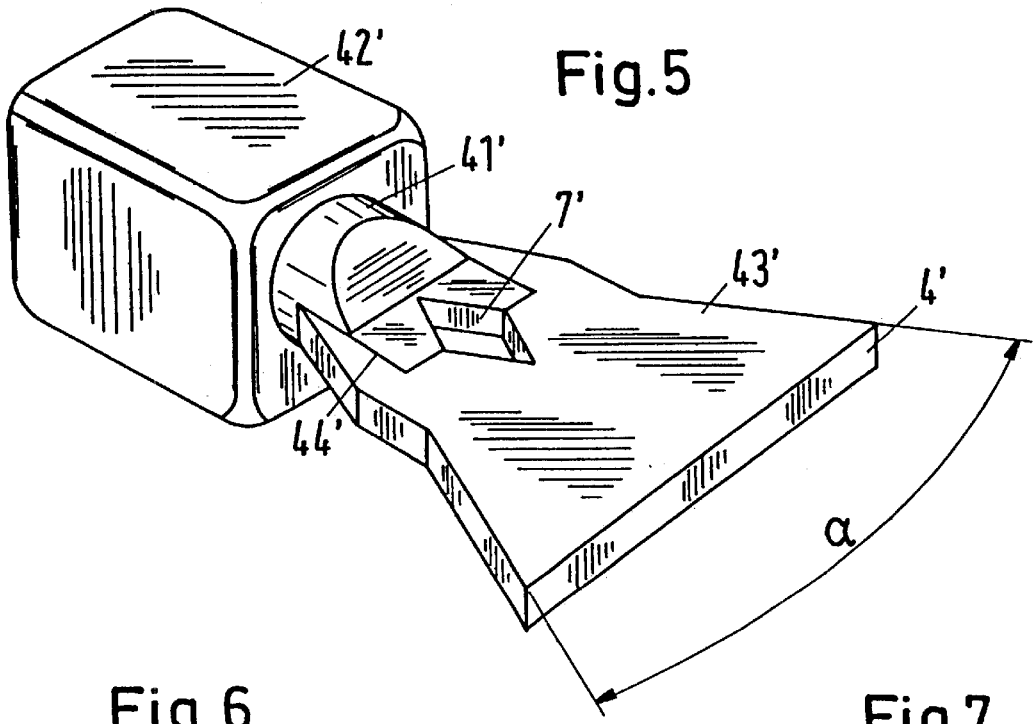
Fig.5
Fig.6
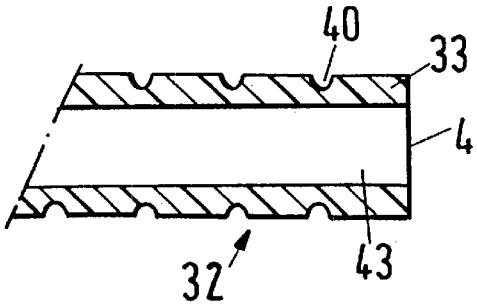
Fig.7
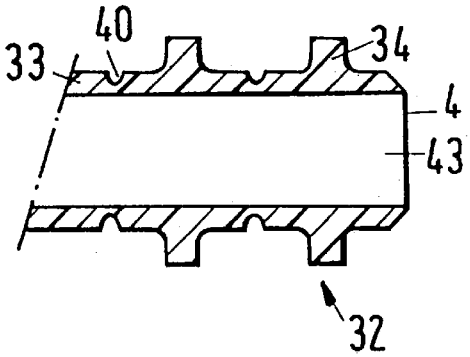
Fig.8
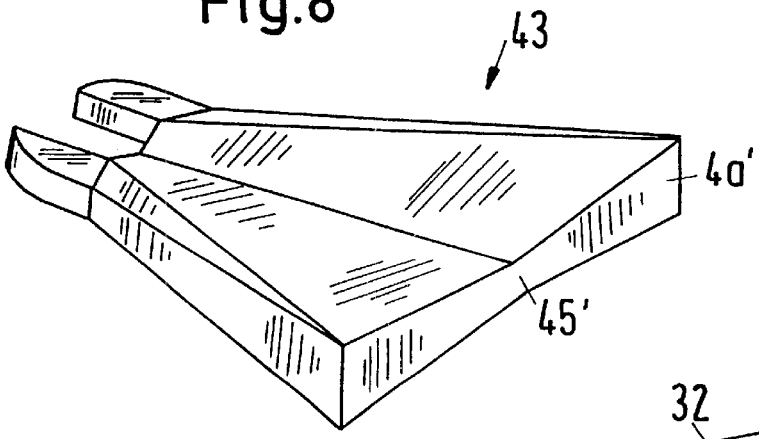
Fig.9
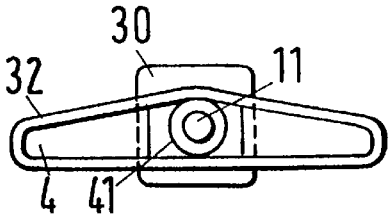

ADAPTER FOR A STATIC MIXER

BACKGROUND OF THE INVENTION

The invention relates to an adapter for a static mixer for carrying out a shaped dispensing of a viscid mixture from the mixer. The adapter is formed as a plastic injection-molded part such that it is mountable on a discharge orifice of the mixer and such that it forms a passage with a variable cross-section with a wall. The flow of the mixture is guidable though the passage to a slit-shaped outlet opening.

EP-A-0 579 889 discloses a mixer with adapter, called an attachment. Two components from a double cartridge can be mixed to a viscid, largely homogeneous mass in the mixer. A shaped dispensing of the viscid mixture can be carried out with the adapter, which is mounted on, or pushed onto, a discharge orifice; that is, the mass to be discharged can be given a certain shape by means of a suitably shaped outlet opening of the adapter. A plurality of shapes of the discharged beads can be generated by using different adapters, for example wedge-shaped beads with triangular outlet openings or strip-like flat beads with slit-shaped outlet apertures.

SUMMARY OF THE INVENTION

It is an object of the invention to provide an adapter for the manufacture of strip-like beads which easily allows the discharge of beads having different, but pre-settable widths by means of a preparation of the adapter. This object is attained by providing the passage wall of the adapter with linear cutting aids on the outside which extend at least approximately parallel to the slit direction of the outlet opening and along which the passage wall can be cut through so that a new, slit-shaped outlet opening is created which is shorter than the original outlet opening in the slit direction, with the linear cutting aids being arranged so that the newly made outlet openings have pre-set cross-sectional areas.

The adapter is provided for a static mixer to carry out a shaped dispensing of a viscid mixture from the mixer. The adapter is formed in the shape of a plastic injection-molded part such that it is mountable on a discharge orifice of the mixer. It forms a passage with a variable cross-section with a wall, with the flow of the mixture being guidable through said passage to a slit-shaped outlet opening. The passage wall is provided with linear cutting aids on the outside which extend at least approximately parallel to the slit direction of the outlet opening. The passage wall can be cut through along these cutting aids so that a new slit-shaped outlet opening is created which is shorter than the original outlet direction in the slit direction. The linear cutting aids are arranged such that the newly made outlet openings have pre-set cross-sectional areas.

The invention will be described below with reference to the drawings.

BRIEF DESCRIPTION OF THE DRAWINGS

FIG. 1 shows a discharge device having a double cartridge and a static mixer;

FIG. 2 shows the tip and discharge orifice of the static mixer;

FIG. 3 shows an adapter in accordance with the invention which is mounted on the mixer tip;

FIG. 4 shows a second embodiment of the adapter in accordance with the invention;

FIG. 5 shows an injection-molding core for the adapter of FIG. 4;

FIG. 6 is a longitudinal section through the adapter in accordance with the invention situated in the region of the outlet opening;

FIG. 7 is a longitudinal section as in FIG. 6 for a variant form of the adapter;

FIG. 8 shows an injection-molding core for a third embodiment of the adapter;

FIG. 9 is a plan view of the outlet opening of a fourth embodiment; and

DESCRIPTION OF THE PREFERRED EMBODIMENTS

Figure 10:
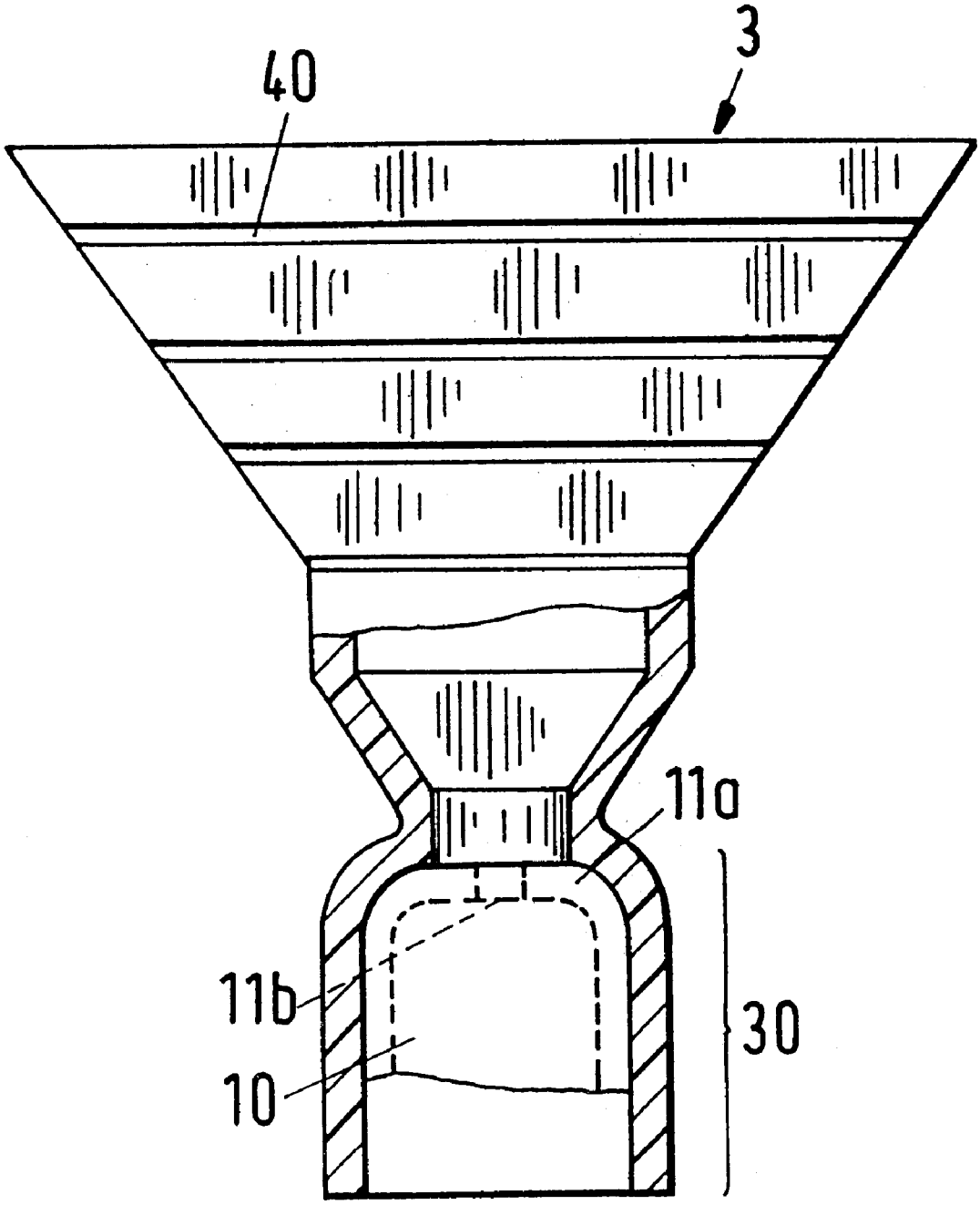
FIG. 10 shows a mixer tip having an adapter in which the tip is formed only as a discharge orifice.

The discharge device illustrated schematically in FIG. 1 consists of a static mixer 1 having a tube 10 and a tip 11 and of a double cartridge 2 having two containers 20*a* and 20*b* from which pasty components can be pressed into the mixer 1 by pistons 22 and mixed there. The mixer 1 is connected to the cartridge 2 by means of a bayonet fastening 21. (Different joints between the mixer 1 and the cartridge are also known.) The tip 11, which is shown in more detail in FIG. 2, has cylindrical segments 12, 120 arranged in a wedge shape and having stepped diameters. A mixer element 13 is located in the tube 10, which is a square tube. The tip 11 is the discharge orifice of the mixer 1 onto which an adapter 3 in accordance with the invention—see FIGS. 3 and 4—can be mounted.

The adapter 3 is made of a plastic in an injection-molding process. Three regions arranged one after another can be distinguished: an attaching region 30, a transition region 31 and an outlet region 32. The adapter 3 forms a passage with a variable cross-section with a wall 33 and the flow of the mixed components is guided through this passage from the discharge orifice 11 of the mixer 1 to a slit-shaped outlet opening 4. A circular cylindrical through-section 41 is located in the attaching region 30 and is advantageously formed such that a segment 120 of the mixer tip 11 can be inserted into it in a tight-fitting manner. The wall 33 is formed in a complementary manner to the surface of the mixer tube 10 in the rear part of the attaching region 30. The dimensions of the attaching region 30 are selected such that the adapter 3 can be attached to the mixer 1 by being placed on it, with it being fixed in place in the example shown only due to static friction. A snap-in mechanism can also be provided between the attaching region 30 of the adapter 3 and the mixer tube 10 for a more effective fixing. A sealing of the adapter 3 to the rear can be made by means of a tight fit between the through-section 41 and the segment 120 and/or between the attaching region 30 and the mixer tube 10.

The passage wall 33 is provided with linear cutting aids 40 on the outside of the outlet region 32 which extend at least approximately parallel to the slit direction of the outlet opening 4. The passage wall 33 can be cut through along the cutting aids 40. When the front part is cut away, a new, slit-like outlet opening 4*a* is created which is shorter in the slit direction than the original outlet opening 4. The linear cutting aids 40 are positioned such that pre-set cross-sectional areas are obtained with the newly made outlet openings 4*a*.

The linear cutting aids 40 can simply be lines pressed onto the wall 33. However, these cutting aids 40 are advantageously formed as grooves.

The linear cutting aids 40 are advantageously provided with characterizing markings 5 which allow a direct reading or a reading by code of how large the cross-sectional area of the newly made outlet opening 4*a* is. In the example of FIG. 3, the numerals 2 to 6, which are indicated as the markings 5, are proportional to the slit length of the outlet openings 4 or 4*a*.

FIG. 4 shows a second embodiment of the adapter 3. This is provided for a dispensing of beads which are wider in comparison with the adapter 3 of FIG. 3. The transition region 31 is provided with a flow divider 7 in this adapter 3, said flow divider 7 effecting the rapid transverse spread of the flow exiting from the discharge orifice 11.

FIG. 5 shows an injection-molding core for the adapter 3 of FIG. 4, said core being assembled from two parts 42' and 43'. The parts 42' and 43' correspond to the respective hollow spaces 42 and 43 in the adapters 3 of FIGS. 3 and 4. A recess 7', which corresponds to the flow divider 7, is located at a common border 44' of the two parts 42' and 43'. The front side 4' of the part 43' corresponds to the slit-shaped outlet opening 4. The cylindrical flat piece 41' corresponds to the through-section 41.

The outlet region 32 essentially has the shape of a trapezoid in a plane set by the transport direction of the mixture and the slit direction of the outlet opening 4, the non-parallel opposite sides of said trapezoid forming an angle $\alpha$ (see FIG. 5) which has a value in the range between 40° and 90° preferably between 60° and 70°.

The original outlet opening 4 has a length in the slit direction which is 5 to 20 times greater than the width of the cutlet opening; the original and the newly made outlet openings 4*a* are largely of the same size.

The front part of the outlet region 32 with the wall 33, the hollow space 43 and the outlet opening 4 is shown as a longitudinal section in FIGS. 6 and 7. The grooves 40 are round flutes in a planar surface in FIG. 6. In the example of FIG. 7, the strips between the grooves 40 are reinforced by ribs 34.

The original outlet opening 4 and the newly made outlet openings 4*a* each have a largely rectangular slit shape in the adapters of FIGS. 3 and 4. These openings 4 and 4*a* respectively can also be triangular or pentagonal. Furthermore, a different slit shape with a variable width is also feasible, where the width tapers towards the center. The front part 43 of an injection-molding core is illustrated in FIG. 8 for this embodiment. The reference numeral 45' indicates the position of the narrowest point of the outlet opening 4, which corresponds to the area 4*a'*. In this embodiment, the flow resistance in the central zone of the outlet region 32 is somewhat increased. In a rectangular outlet opening 4, the flow speed En the central region is higher than in the side regions of the outlet region 32. A restriction of the flow in the central region due to the increased flow resistance can effect a homogenization of the discharge in a suitable design.

A plan view of the outlet opening 4, which is approximately pentagonal (shape of a flat, isosceles triangle in which the two corner regions of the triangle base have been removed in a symmetrical manner), is shown for a fourth embodiment in FIG. 9. In addition to the outlet region 32, the attaching region 30, the through-section 41 and the mixer tip 11 can be seen in this illustration.

FIG. 10 shows a mixer tip 11*a* with an adapter 3 in which the discharge orifice is formed only in the shape of an outlet opening 11*b*. When mixers 1 are used with the adapter 3, tips 11 in accordance with FIG. 2 can be dispensed with.

What is claimed is:

1. An adapter for a shaped dispensing of a viscid mixture from a static mixer having a discharge orifice from which the mixture flows in a flow direction into the adapter, the adapter comprising an upstream end formed to be connected to the mixer so that an interior of the adapter is in flow communication with the orifice, first and second wall portions which diverge from the upstream end in the flow direction to a downstream end of the adapter defining an original slit-shaped outlet opening, and linear cutting aids on an outside of the adapter which are at least approximately parallel to the original slit-shaped outlet opening and along which the wall portions can be severed to create a new slit-shape outlet opening which has a lesser length than the original slit-shape outlet opening.

2. An adapter according to claim 1 wherein the linear cutting aids are arranged to define new slit-shaped outlet openings having predetermined cross-sectional areas.

3. An adapter according to claim 2 including characterizing markings associated with the linear cutting aids, the characterizing markings including information on the size of the cross-sectional area of the new outlet openings obtained when cutting the adapter along respective cutting aids.

4. An adapter according to claim 3 wherein the characterizing markings comprise markings which are directly readable or which are readable by means of a code.

5. An adapter according to claim 1 wherein the linear cutting aids comprise grooves formed in the adapter.

6. An adapter according to claim 1 wherein the adapter comprises first, second and third regions serially arranged from the upstream end of the adapter in the flow direction for flowing the mixture from the discharge orifice to the downstream end of the adapter, the first region defining an attachment section of the adapter for connecting the adapter to the mixer, the second region defining a transition section, and the third region defining an outlet section of the adapter which terminates in the original slit-shaped outlet opening, wherein the linear cutting aids are applied to the outlet section.

7. An adapter according to claim 6 wherein the outlet section substantially has the shape of a trapezoid in a plane defined by the flow direction of the mixture and a direction of the slit-shaped outlet opening, nonparallel, opposite sides of the trapezoid defining an angle which diverges in the flow direction by between 40° and 90°.

8. An adapter according to claim 7 wherein the angle is in a range between 60° and 70°.

9. An adapter according to claim 6 wherein the original slit-shaped outlet opening has a slit of a length which is 5 to 20 times greater than a width of the outlet region in a direction substantially perpendicular to the slit, and wherein a width of the adapter in the direction substantially perpendicular to the slit remains substantially constant from the original outlet opening to at least a first one of the cutting aids.

10. An adapter according to claim 6 wherein the original outlet opening and any subsequently formed new outlet openings each have a slit shape which is substantially one of a rectangular shape, a triangular shape and a pentagonal shape.

11. An adapter according to claim 6 wherein the original slit and the newly generated slit each have a width perpendicular to the slit which tapers from lateral sides of the slit towards a center of the slit.

12. An adapter according to claim 6 including a flow divider arranged in the transition section.

13. A discharge apparatus comprising a two-component cartridge, a static mixer terminating in a discharge orifice, and an adapter for a shaped dispensing of a viscid mixture which flows from the discharge orifice in a flow direction into the adapter, the adapter including an upstream end formed to be connected to the mixer so that an interior of the adapter; is in flow communication with the orifice, first and second wall portions which diverge from the upstream end in the flow direction to a downstream end of the adapter defining an original slit-shaped outlet opening, and linear cutting aids on an outside of the adapter which are at least approximately parallel to the original slit-shaped outlet opening and along which the wall portions can be severed to create a new slit-shape outlet opening which has a lesser length than the original slit-shape outlet opening.

14. An adapter for mounting on a mixer so that mixed fluid from the mixer flows into the adapter for discharging a shaped flow of the fluid, the adapter comprising an upstream section adapted to be connected to the mixer and defining a flow passage for flowing the mixture in a flow direction from the upstream end to a downstream end of the adapter, first and second, opposing wall sections which extend over at least a portion of a length of the adapter divergingly in the flow direction to define an original adapter outlet opening forming an elongated slit disposed between the opposing walls portions for forming the shaped liquid flow and discharging it from the elongated slit, and a plurality of cutting aids on an exterior surface of the adapter arranged substantially parallel to the original outlet opening and spaced therefrom in a direction opposite the flow direction for facilitating severing parts of the adapter including the original outlet opening and forming a new outlet opening which has a lesser length than the original outlet opening.

* * * * *